US012295499B2

(12) United States Patent
Bouali et al.

(10) Patent No.: US 12,295,499 B2
(45) Date of Patent: May 13, 2025

(54) WEARABLE CHILD CARRIER

(71) Applicant: Alibaby B.V., Haarlem (NL)

(72) Inventors: Ali Bouali, Haarlem (NL); Stefan Van Cleef, Haarlem (NL); Heleen Willemsen, Haarlem (NL); Boudewijn Martin Wisse, Haarlem (NL); Michael Martinus Hölscher, Haarlem (NL)

(73) Assignee: Alibaby B.V., Haarlem (NL)

( * ) Notice: Subject to any disclaimer, the term of this patent is extended or adjusted under 35 U.S.C. 154(b) by 150 days.

(21) Appl. No.: 18/022,864

(22) PCT Filed: Sep. 2, 2021

(86) PCT No.: PCT/EP2021/074275
§ 371 (c)(1),
(2) Date: Feb. 23, 2023

(87) PCT Pub. No.: WO2022/049198
PCT Pub. Date: Mar. 10, 2022

(65) Prior Publication Data

US 2023/0263314 A1 Aug. 24, 2023

(30) Foreign Application Priority Data

Sep. 3, 2020 (NL) ..... 2026402
Jul. 9, 2021 (NL) ..... 2028680

(51) Int. Cl.
*A47D 13/02* (2006.01)

(52) U.S. Cl.
CPC ..... *A47D 13/025* (2013.01); *A47D 13/029* (2022.08)

(58) Field of Classification Search
CPC ..... A45F 3/08; A47D 13/025; A47D 13/027; A47D 13/029
(Continued)

(56) References Cited

U.S. PATENT DOCUMENTS 4,915,277 A 4/1990 Larreategui
2009/0302075 A1 12/2009 Trainer
(Continued)

FOREIGN PATENT DOCUMENTS

CN 111227570 A 6/2020
DE 39 16370 A1 11/1990
(Continued)

OTHER PUBLICATIONS

DE-102010025905-A1 Translation, Demirkiran A, Feb. 24, 2011 (Year: 2011).*

*Primary Examiner* — Derek J Battisti
*Assistant Examiner* — Matthew T Theis
(74) *Attorney, Agent, or Firm* — Hoffmann & Baron, LLP

(57) ABSTRACT

A wearable child carrier to be worn by a person to carry a child close to his torso includes a hip belt and a child seat with a seat bottom and a backrest. The child carrier includes a pair of suspension beams for transferring a load from the child seat to the hip support. Each suspension beam has a beam body with a proximal beam end being connected to the hip support. Each beam body is connected to the backrest of the child seat. The connection to the backrest is beneficial in that an improved load transfer from the child seat to the hips is obtained. In addition, the beam body may form a leg restraint for the child to provide lateral stability.

13 Claims, 6 Drawing Sheets

(58) Field of Classification Search
USPC ..... 224/158–161
See application file for complete search history.

(56) References Cited

U.S. PATENT DOCUMENTS

| | | | | |
|---|---|---|---|---|
| 2015/0216323 | A1 | 8/2015 | Ueno | |
| 2015/0245718 | A1* | 9/2015 | Lundgren | A45F 3/08 224/161 |
| 2021/0169237 | A1 | 6/2021 | Zhu | |

FOREIGN PATENT DOCUMENTS

| | | | | |
|---|---|---|---|---|
| DE | 39 16380 | A1 | 11/1990 | |
| DE | 102010025905 | A1 * | 2/2011 | A47D 13/025 |
| EP | 0662292 | A1 * | 7/1995 | A47D 13/027 |
| SE | 1950894 | A1 | 7/2019 | |
| WO | 2018/229772 | A1 | 12/2018 | |

* cited by examiner

WEARABLE CHILD CARRIER

CROSS-REFERENCE TO RELATED APPLICATIONS

This application is the National Stage of International Application No. PCT/EP2021/074275, filed Sep. 2, 2021, which claims the benefit of Netherlands Application Nos. NL 2026402, filed Sep. 3, 2020, and NL 2028680, filed Jul. 9, 2021, the contents of all of which are incorporated by reference herein.

FIELD OF THE INVENTION

The present invention relates to a wearable child carrier to be worn by a person to carry a child close to his torso. The child carrier comprises a hip support including a hip belt for surrounding a pelvic region of the person. Ends of the hip belt are provided with a hip belt closure. The child carrier further comprises a child seat for holding the child. The child seat has a seat bottom and a backrest. To transfer a load from the child seat to the hip support, the child carrier comprises a pair of suspension beams being connected to the hip support.

BACKGROUND OF THE INVENTION

WO2018/229772 discloses a child carrier which is connectable to a harness. The harness is arranged to support a load carrier, such as a child carrier. The harness has an upper portion formed by a pair of shoulder straps and a lower portion formed by a waist belt. At an upper region, the child carrier is connected to the pair of shoulder straps. At a lower region, the child carrier is connected to a front or back portion of the waist belt.

The harness is reinforced by a pair of interconnecting support beams extending in between the waist belt and the shoulder straps. Each support beam has a lower end connected to the waist belt and an upper end connected to the upper portion at an anchoring position. The interconnecting support beams contribute to transfer at least a portion of a load from the shoulder straps to the waist belt.

A drawback of this known child carrier is that its comfort level is poor. Although a portion of the load is deducted from the shoulder straps by the interconnecting support beams, a considerable load on the upper body remains. The presence of the shoulder straps is often practised as cumbersome. The shoulder straps hinder a free movement of the upper body.

US2009/0302075 discloses a child carrier which comprises a harness and the pouch. The harness is designed to be worn by a person wishing to carry a child. The pouch is designed to receive a child that the person wishes to carry. The harness includes shoulder belts, a hip belt, a frame mounted on the hip belt and a load-transmitting fastener formation carried on or forming part of the frame. The frame is positioned in between the shoulder belts and the hip belt. It is said that the arrangement is such that in use, the majority of the weight of the pouch and its contents are transferred via the frame to the hip belt and thus to the pelvic region of the person wearing the harness.

In comparison with the child carrier disclosed in WO2018/229772, the load transfer from the child seat to the hip belt is improved due to the suspension of the pouch directly to the frame. However, a considerable load may still be transferred to the shoulder straps of the harness. A percentage of a transferred load to the shoulder straps instead of to the hip belt depends on an adjustment of the shoulder straps with respect to the hip belt. Tightening the shoulder straps will result in a higher load to be carried by the shoulders of the person wearing the child carrier, and will at least partly disable the load carrying function of the frame.

Regarding the above-mentioned prior art, it is remarked that any discussion of documents, acts, materials, devices, articles or the like included in the present specification is for the purpose of providing a context for the present invention, and is not to be taken as an admission that any such matters form part of the prior art or were before the priority date of each claim of this application common general knowledge in the field relevant to the present invention.

The general object of the present invention is to at least partially eliminate the above mentioned drawbacks and/or to provide a usable alternative. More specific, it is an object of the invention to provide a child carrier for carrying a child on a user's upper body in which a load transferred to the upper body is reduced. Further, it is an object of the invention to provide a child carrier which is comfortable in use.

SUMMARY OF THE INVENTION

This object is achieved by a wearable child carrier according to the invention.

A wearable child carrier to be worn on a torso of a person is provided. The child carrier is arranged to carry a child.

The child carrier comprises a hip support including a hip belt for surrounding a pelvic region of the person. The hip belt is provided with a hip belt closure. The hip belt closure has a first closure member connected at a first end of the hip belt and a second closure member connected to a second end of the hip belt.

The child carrier comprises a child seat for holding a child. The child seat has a seat bottom and a backrest. Preferably, the seat bottom is directly connected to the hip support.

The child carrier further comprises a pair of suspension beams. The suspension beams are arranged for transferring a load from the child seat to the hip support. Each suspension beam has a beam body. Each beam body is connected to the backrest of the child seat. Preferably, each beam body is connected to a side region of the child seat, in particular laterally connected to a side region of the backrest. A proximal beam end of the beam body is connected to the hip support. In particular, the proximal beam end is connected to a left or right hip region of the hip belt. Herewith, each suspension beam transfers a load from the child seat to the hip support.

Each suspension beam extends in between the hip belt and the child seat which is beneficial in that the connection by the suspension beams contributes to a direct load transfer from the child seat to the hip belt. The direct connection allows the child carrier to be arranged without shoulder belts. In addition, each suspension beam may form a lateral restraint to restrain a child in the child seat. A suspension beam which extends downwardly from a backrest of the child seat to a hip belt is beneficial in that this structure may leave the arms of the child freely movable. Herewith, the child carrier provides comfort to the child.

In comparison with the prior art child carrier of US2009/0302075 having a front positioned hip belt closure in between the frame portions, the wearable child carrier according to the invention is more convenient in that it allows the person to attach the child carrier around his torso without a need of first pulling a harness over his head. In addition, instead of a centrally positioned front mounted pouch, the child seat according to the invention is connected to a backrest of the child seat which provides an improved support in carrying a child, because the support according to the invention is positioned closer to a gravity point of the child seat.

In comparison with the prior art child carrier of WO2018/229772, the connection of the suspension beams to the child seat according to the invention instead of to the harness contributes to an improved load transfer from the child seat to the hip support. A lateral connection of each suspension beam to the child seat may provide a further benefit in that the suspension beam may form a lateral restraint. The downwardly extending suspension beam in between the child seat and the hip belt may laterally restrain the child in the child seat which contributes to the child carrier safety.

In an embodiment of the child carrier according to the invention, each beam body has a lower beam portion which has a curvature directed towards the child seat. The lower beam portion is preferably arc-shaped in which the lower beam portion extends along a bow. Preferably, the lower beam portion has a single bend which is in use of the child carrier directed away from the person's body wearing the child carrier.

Preferably, the curvature of the lower beam portion extends away from the hip belt in a substantial perpendicular direction. In use, the lower beam portion is then oriented in an upwards direction. The beam body bends to the child seat. Herewith, the lower beam portion may delimit a leg opening of the child seat. When a child is received in the child seat, a child's leg is put through the leg opening. Herewith, advantageously, the suspension beam further serves as a restraint in a lateral direction to restrain the child in the child seat. The suspension beams contribute to a predefined and safe positioning of a child.

In comparison with the prior art child carrier of US2009/0302075 which discloses a front connected pouch, according to the invention each beam body is preferably laterally connected to the child seat. Preferably, the beam body is connected to a backrest of the child seat. Herewith, the pair of suspension beams provide a support to the child seat in a position closer to a point of gravity which is beneficial in transferring a load and momentum from the child seat to the hip belt.

In an embodiment of the child carrier according to the invention, the proximal beam end is pivotally about a beam pivot point over a predetermined beam pivot angle $\alpha$ connected to the hip belt. In particular, the pivot angle $\alpha$ is at most 25°. The pivotal connection of the suspension beam to the belt allows a certain rotation of the child seat away from a person's torso. The child seat is rotatable away from the person from a raised position in which a child may be held against the upper body of the person to a lowered position in which the child may lay back and facing the person. The lowered position is advantageous in that it allows the person to have eye contact with the child in an convenient way.

In an embodiment of the child carrier according to the invention, each beam body has an upper beam portion having a curvature. Preferably, the curvature extends in a direction opposite a direction of the curvature of the lower beam portion, such that the beam body has a S-shape. Advantageously, the lower beam portion forms a leg opening for receiving a child's leg, and the upper beam portion extends along an upper region of the child seat, in particular along a headrest of the child seat as a reinforcement of the child seat.

In an alternative embodiment of the child carrier according to the invention, the curvature of the lower beam portion may extend away from the hip belt in a substantial parallel direction with the hip belt. From the proximal beam end, the lower beam portion extends along the hip belt. At a certain distance the lower beam portion may deflect away from the hip belt in an upwards direction. Herewith, the lower beam portion may extend along a lower region of the child seat. In particular, the lower beam portion may form a contour of the seat bottom. The child sitting in the child seat is then supported from beneath under the child's legs by the suspension beam. The lower beam portion may beneficially provide a reinforcement of the child seat. The reinforcement may extend from the seat bottom through the backrest of the child seat, in particular to a headrest of the child seat.

In an embodiment of the child carrier according to the invention, the suspension beams are interconnected at a top region of the child seat. The suspension beams may be mounted to each other. Preferably, a bridge member is positioned in between the distal beam ends of the suspension beams. The bridge member serves as a spacer between the distal beam ends. The bridge member may form a reinforcement of the child seat.

In an embodiment of the child carrier according to the invention, the child seat is positioned at a middle region of the hip belt. Hence, in use, the child seat is positioned at a torso side opposite the hip belt closure. When wearing the child carrier, the child seat may be positioned at a front, in which the hip belt closure is positioned at a back of the person, or vice versa.

A benefit of the hip belt closure opposite the child seat is that the child carrier can be attached quickly to the person's body. The person may position the child seat at a front of the person's body and close the hip belt closure at a back of the person's body. The child carrier may be ready for receiving a child into the child seat, just after a single step of closing the hip belt closure at just one position. No plurality of snap-on closures are necessary to deal with when putting on the child carrier.

In an embodiment of the child carrier according to the invention, each suspension beam is undetachable connected to the child seat. Each suspension beam is unreleasable mounted to the child seat. Preferably, each suspension beam is attached to the backrest of the child seat. The backrest may comprise a backrest connector for connecting a suspension beam to the backrest. A permanent fixation of the suspension beam to the child seat contributes to achieve a simple configuration of the child carrier which is convenient in use.

In an embodiment of the child carrier according to the invention, the child carrier further comprises a suspension support. The suspension support may be formed as a waist support, in particular a waist belt, which is configured to extend along a waist of a person. The waist belt may substantially circumvent a person's waist. Preferably, one end of the suspension support, a suspension support distal end, is connected to one of the child seat and suspension beam, and the other end, a suspension support proximal end, is connected to the hip belt, preferably at a position of the hip belt closure. Alternatively, one end of the suspension support may be attached to one of a left side of the backrest and the left suspension beam, and the other end of the waist belt may be attached to one of a right side of the backrest and the right suspension beam, wherein in use the suspension support extends along a back of the person, such that a pivotal movement of the suspension beams is limited by the suspension support. Herewith, the suspension support interconnects the child seat and the hip support for supporting the child seat in a direction away from the person. Instead of, or in combination with the beam stopper, the suspension support limits a beam pivot angle α of each suspension beam to delimit the lowered position of the child seat.

Preferably, the distal end of the suspension support is connected to one of the child seat and the suspension beam by a suspension support connector. Preferably, the suspension support connector is connected to the backrest of the child seat. The suspension support connector may also be called a backrest connector. Preferably, the backrest connector is adapted to adjust a length of the suspension support to allow the person to adjust the lowered position of the child seat. The waist belt may be formed by a strap which is adjustable in length by the suspension support connector. The person wearing the child carrier may pull the strap through the backrest connector to adjust lowered position in height.

In an embodiment of the child carrier according to the invention, the child carrier further comprises a lumbar support for bearing upon a lower back portion of the person. In use, the lumbar support covers a person's lower back just above the pelvic region. Preferably, the lumbar support is incorporated in the hip support. The lumbar support may be formed by a panel shaped pad which is sized in correspondence with a person's lower back. The panel shaped pad may be connected with one end of the hip belt, and/or a waist belt proximal end. Preferably, the waist belt proximal end and an end of the hip belt are stacked on the lumbar support. Preferably, in a closed position of the hip belt, the hip belt closure is positioned on the lumbar support.

In an embodiment of the child carrier according to the invention, the child carrier further comprises at least one shoulder belt, in particular a pair of shoulder belts. Each shoulder belt has a shoulder band to be placed around a shoulder and a shoulder strap to be charged below an arm of a person. The shoulder band is connected, preferably releasably, by an upper shoulder connector to an upper region, in particular a headrest, of the child seat. The shoulder strap is connected to one of the suspension beam or at a lower region of the child seat, in particular to the backrest of the child seat. Preferably, the pair of shoulder belts are arranged crosswise which beneficially provides a lateral stability to the child seat.

In an embodiment of the child carrier according to the invention, the child carrier further comprises an abdominal pad, or a so called belly pad, for bearing upon an abdominal region of the person. The abdominal pad is positioned in between the child seat and the hip belt. The abdominal pad is connected to the seat bottom of the child seat. The abdominal pad may be connected to one of the hip belt or the pair of suspension beams. The abdominal pad may be incorporated into the hip support, such that the hip belt and the abdominal pad form a one-piece item. More in particular, the abdominal pad, the seat bottom and the hip belt may be fixed to each other to form a one piece item. Herewith, the child seat is indirectly connected to the hip belt by the abdominal pad. Advantageously, the abdominal pad may allow a height adjustment of child seat with respect to the hip support.

Further preferred embodiments are defined herein.

In a second aspect, the invention relates to a child carrier with a child seat which child carrier is arranged to be worn by a person to carry a child.

Many embodiments of child carriers are known from the prior art. Any discussion of documents, acts, materials, devices, articles or the like regarding such a known child carrier is included in the present specification for the purpose of providing a context for the present invention, and is not to be taken as an admission that any such matters form part of the prior art or were before the priority date of each clause of this application common general knowledge in the field relevant to the present invention.

Child carriers are known which are configured to be attached to an upper body of a person to reduce a weight on a neck and shoulder area. US2015216323 discloses an embodiment of such a child carrier. The child carrier comprises a waist-mounted baby harness including a semi-rigid, generally concave harness shell which defines a generally hemispherical infant enclosure, which wraps around the infant's head, neck and torso. The harness shell has bilateral tapered belt extensions, which are configured to wrap around the adult's waist and hips from the back and close together, in the area of the adult's waist and hips, secured by an adjustable belt closure. With the belt extensions secured around the adult's waist/hips, the infant is supported along the adult's back, waist, pelvis and/or buttocks area, such that the adult's hands remain free, his/her shoulders are unburdened of straps, and the baby's weight does not impede the adult's upper body mobility, including bending from the waist.

WO2018/229772 discloses a child carrier which is connectable to a harness. The harness is arranged to support a load carrier, such as a child carrier. The harness has an upper portion formed by a pair of shoulder straps and a lower portion formed by a waist belt. At a lower region, the child carrier is connected to a front or back portion of the waist belt. At an upper region, the child carrier is connected to the pair of shoulder straps. A pair of interconnecting support beams is provided extending in between waist belt and the shoulder straps. Each support beam has a lower end connected to the waistband and an upper end connected to the upper portion at an anchoring position. Due to the interconnecting support beams, at least a portion of a load is transferred from the shoulder straps to the waistband.

A drawback of the known child carrier is that its comfort level is poor. Although a portion of the load is transferred away from the shoulder straps by the interconnecting support beams, a considerable load on the upper body remains. The presence of the shoulder straps is often practised as cumbersome. The shoulder straps hinder a free movement of the upper body.

The general object of the second aspect of the invention is to at least partially eliminate the above mentioned drawbacks and/or to provide a usable alternative. More specific, it is an object of the invention to provide a child carrier for carrying a child on a user's upper body in which a load transferred to the upper body is reduced. Further, it is an object of the invention to provide a child carrier which is comfortable in use, especially when standing for a while or during a saunter with the child carrier.

According to a second aspect of the invention, this object is achieved by a child carrier according to clause 1.

According to the second aspect of the invention, a child carrier is provided which is arranged to be worn by a person to carry a child. In particular, the child carrier is a front-carrying child carrier which is arranged to carry a child in front of an upper body of a person. The child carrier comprises a hip support. The hip support includes a hip belt for surrounding a pelvic region of the person. Further, the child carrier comprises a lumbar support for a bearing upon a lower back portion of the person.

A pair of suspension beams is provided which includes a left and right suspension beam. Each suspension beam has a beam body with a proximal beam end and a distal beam end. The proximal beam end is connected to the hip support and the distal beam end is extending away from the hip support.

Further, the child carrier comprises a child seat for holding the child. The child seat has a seat bottom and a backrest. The backrest includes at least one backrest connector for connecting or disconnecting the backrest to one of the suspension beams. The at least one backrest connector is manually detachable from the distal beam end of one of the suspension beams for receiving a child in the child seat. Preferably, the backrest has a left and right backrest connector to allow a left or right user operation.

The invention may provide several advantages. The backrest of the child seat is directly connected to the pair of suspension beams. As a result, a load of the child seat is directly transferred via the suspension beams to the hip support. The child seat is suspended by the pair of suspension beams which means that additional items, like shoulder straps may be omitted to carry the load. A major advantage of the child carrier according to the invention is that the child carrier can be embodied without shoulder straps. A total load of a child's weight can be transferred to the hip region. The load is carried on the hips. A person's shoulder and neck area may remain unloaded which may prevent neck and shoulder complaints.

An upper body of a person need not be hindered by any additional fastening means. Advantageously, the person wearing the child carrier may freely twist the upper body and rotate the shoulders. The freedom of movement is beneficial in everyday practises like grabbing something out of an upper kitchen cabinet etc.

The presence of the hip belt in combination with the lumbar support is arranged to transfer the load from the child seat to the hip of the person in an effective manner. In use, the child seat is situated above the hip in front or at a back of a person, such that the load introduces a momentum onto the hip support. Due to the momentum, the hip support tends to tilt. The combination of the hip belt surrounding the pelvic region of the person and the lumbar support situated at a lower back portion of the person optimally anticipate on this introduced momentum. The bearing onto the pelvic region in combination with the bearing somewhat higher onto the lower back portion optimally compensate the introduced momentum via the pair of suspension beams.

In an embodiment of the child carrier according to the invention, the seat bottom of the child seat is connectable to at least one of the lumbar support and the pair of suspension beams. The seat bottom comprises a left and/or right seat bottom connector for manually connecting the seat bottom to the lumbar support and/or the pair of suspension beams. In use, the seat bottom connector is preferably positioned at a lateral side of the person.

In comparison with the known child carrier as disclosed in WO2018/229772, in which the seat bottom is connected to a front portion of a waist belt, the seat bottom of the child seat according to the invention is connectable to the lumbar support or the pair of suspension beams. A load from the child seat is transferred to the lower back portion of the person or via the pair of suspension beams to a lateral side of the hip region instead of a front side of a waist belt. Such transfer of a load to the pelvic region or lower back portion is considered to be more comfortable to a person wearing the child carrier.

In an embodiment of the child carrier according to the invention, the child seat is adjustable in position along a beam body of a suspension beam. A relative height of the child seat can be adjusted by positioning the backrest connector and/or seat bottom connector relative to the suspension beam. Advantageously, this possibility of an adjustment warrant a proper positioning of the hip support at the pelvic region. Independent of a person's or child's length, the adjustment always enables a positioning of the hip support at the pelvic region. Herewith, a correct load transfer to the hip region is warranted. An adjustment of the backrest connector relative to the seat bottom connector is beneficial to adapt a size and position of the child seat to a particular child. The seat bottom connector and/or backrest connector may for example be slidable connected to the beam body. Preferably, the seat bottom connector comprises a seat bottom adjuster including an adjuster housing and an adjuster strap, in which the adjuster housing is fixed to the suspension beam, and the adjuster strap can be shortened or lengthened by a user to adjust a relative height of the seat bottom.

In an embodiment of the child carrier according to the invention, a beam body of a suspension beam is adjustable in length. A user may lengthen a suspension beam to adjust a relative height of the child seat with respect to the users upper body. The beam body may comprise a first and second beam part which are telescopically connected to each other to allow a lengthening of the suspension beam.

In an embodiment of the child carrier according to the invention, the lumbar support is incorporated in the hip support. The lumbar support may be integrally shaped with the hip support. The lumbar support and the hip support may form a one-piece item which can advantageously be quickly attached to the person's body. The person may attach the hip support including the lumbar support to the person's body in one step by closing a hip belt closure.

In an embodiment of the child carrier according to the invention, each suspension beam is connected to the lumbar support. The lumbar support extends in between the left and right suspension beam, wherein the lumbar support is connected to an intermediate region of each suspension beam. Advantageously, the connection in between the lumbar support and the pair of suspension beams increases a positional stability of the suspension beams.

In an embodiment of the child carrier according to the invention, the child carrier further comprises at least one thigh support for bearing upon a front side of a thigh area of a person wearing the child carrier. Preferably, the child carrier comprises a left and right thigh support for distributing a load to both thighs of the person. Each thigh support is connected to the hip support. In particular, each thigh support is connected to one of the suspension beams, such that a load received by a suspension beam is transferred to the thigh support. The load is transferred by the thigh support to the thigh area, such that a load in the child seat which renders a tilting moment is compensated by the person's thighs. Advantageously, the thigh support may contribute to a relief of the lower back portion of the person.

In an embodiment of the child carrier according to the invention, the child carrier further comprises an abdominal pad for bearing upon an abdominal region of the person. When wearing the child carrier the abdominal pad of the seat bottom is abutting to the abdominal region of the person. Preferably, the abdominal pad is fixed to the seat bottom. At its lateral sides, the abdominal pad may be connectable by the seat bottom connector to the lumbar support, e.g. by a snap connection. Preferably, the abdominal pad is incorporated with the lumbar support into a waist belt for encircling a waste of the person. The waist belt comprises the abdominal pad and the lumbar support. The waist belt has a waist belt closure. The waist belt closure may be positioned at a front side of the child carrier. Preferably, the waist belt is releasable at a lateral side. Preferably, the waist belt is releasable at both a left and right side to allow a right or left user operation.

In particular, each thigh support is biased. The thigh support may comprise a thigh pad arranged to abut to a person's thigh. The thigh pad is mounted a distal end of a thigh pad arm. A proximal end of the thigh pad arm is mounted to the hip support, in particular directly to the proximal end of the suspension beam. In particular, the thigh pad arm is adapted to position the thigh pad at an upper region of the person's thigh. Preferably, the thigh pad arm is adapted to extend along a lateral side of a person's leg. Preferably, the thigh pad arm is rotatably mounted to the hip support by a thigh support housing. The thigh support housing may house a spring for biasing the thigh support. In particular, the spring of the thigh support is manually releasable to release the tension of the thigh support which may be beneficial for a user in walking with the child carrier.

Together with the hip belt, the at least one thigh support may compensate a momentum introduced by a load in the child seat. According to a third aspect of the invention, the thigh support may be arranged to substitute the lumbar support of the child carrier. The thigh support may replace the lumbar support. According to this aspect of the invention, the invention relates to child carrier to be worn by a person to carry a child comprising:

- a hip support including a hip belt for surrounding a pelvic region of the person;
- a thigh support arranged to be positioned against a person's thigh when wearing the child carrier;
- a pair of suspension beams including a left suspension beam and a right suspension beam in which each suspension beam has a beam body having a proximal beam end connected to the hip support and a distal beam end extending away from the hip support;
- a child seat for holding a child wherein the child seat has a seat bottom and a backrest including at least one backrest connector which is manually releasable from the distal beam end of one of the suspension beams.

In an embodiment of the child carrier according to the invention, the child carrier further comprises a chest belt for surrounding a chest of a person. The chest belt is arranged to be worn around a shoulder region, in particular around a lower region of the shoulder region, more in particular around the lower ribs of a person. The chest belt may be formed by a chest strap including at least one chest belt closure for attaching the chest belt to the upper body of the person. In use, the chest belt is positioned at the upper body above the lumbar support. Preferably, the chest belt is arranged to be positioned at an upper half region of a person's lower back cavity. The chest belt contributes to keep the child seat close to the person's body.

Together with the hip belt, the chest belt may compensate a momentum introduced by a load in the child seat. According to a fourth aspect of the invention, the chest belt may be arranged to substitute the lumbar support of the child carrier. The chest belt may replace the lumbar support. According to this aspect of the invention, the invention relates to child carrier to be worn by a person to carry a child comprising:

- a hip support including a hip belt for surrounding a pelvic region of the person;
- a chest belt for surrounding a shoulder region of the upper body;
- a pair of suspension beams including a left suspension beam and a right suspension beam in which each suspension beam has a beam body having a proximal beam end connected to the hip support and a distal beam end extending away from the hip support;
- a child seat for holding a child wherein the child seat has a seat bottom and a backrest including at least one backrest connector which is manually releasable from the distal beam end of one of the suspension beams.

In an embodiment of the child carrier according to the invention, the child carrier further comprises at least one shoulder belt. The shoulder belt may contribute in keeping the child seat close to a person's body. At an upper portion, the shoulder belt may be connectable to the backrest of the child seat. In particular, the shoulder belt has upper shoulder belt connector which is connectable to a headrest of the backrest of the child seat to increase a stability of the headrest. At a lower portion, the shoulder belt may be connectable to a suspension beam to increase a stability of the suspension beam. In particular, the shoulder belt has a lower shoulder belt connector which is connectable to one of the suspension beams. The lower shoulder belt connector may include a shoulder strap. The shoulder strap may be connected to the adjuster housing of the seat bottom connector to form the lower shoulder belt connector.

Together with the hip belt, the shoulder belt may compensate a momentum introduced by a load in the child seat. According to a fifth aspect of the invention, the shoulder belt may be arranged to substitute the lumbar support of the child carrier. The shoulder belt may replace the lumbar support. According to this aspect of the invention, the invention relates to child carrier to be worn by a person to carry a child comprising:

- a hip support including a hip belt for surrounding a pelvic region of the person;
- a shoulder belt to be worn across a shoulder;
- a pair of suspension beams including a left suspension beam and a right suspension beam in which each suspension beam has a beam body having a proximal beam end connected to the hip support and a distal beam end extending away from the hip support;
- a child seat for holding a child wherein the child seat has a seat bottom and a backrest including at least one backrest connector which is manually releasable from the distal beam end of one of the suspension beams.

Further embodiments are defined by the following clauses:

1. Child carrier (1) to be worn on a torso of a person (P), which child carrier is arranged to carry a child (C) comprising:
   - a hip support (3) including a hip belt (30) for surrounding a pelvic region (PR) of the person;
   - a lumbar support (4) for bearing upon a lower back portion of the person;
   - a pair of suspension beams (5) including a left suspension beam (51) and a right suspension beam (52) in which each suspension beam has a beam body (50) having a proximal beam end (501) connected to the hip support (3) and a distal beam end (502) extending away from the hip support (3);
   - a child seat (2) for holding a child wherein the child seat has a seat bottom (22) and a backrest (21) including at least one backrest connector (210) which is manually releasable from the distal beam end (502) of one of the suspension beams (51, 52).

2. Child carrier (1) according to clause 1, wherein the seat bottom (22) comprises a seat bottom connector (220) which is connectable to at least one of the lumbar support (4) and the pair of suspension beams (5).

3. Child carrier (1) according to clause 2, wherein at least one of the backrest connector (210) and the seat bottom connector (220) is adjustable in position relative to the suspension beam (51, 52).

4. Child carrier (1) according to any of the preceding clauses, wherein the beam body (50) of the suspension beam is adjustable in length.

5. Child carrier (1) according to any of the preceding clauses, wherein the lumbar support (4) is incorporated in the hip support (3).

6. Child carrier (1) according to any of the preceding clauses, wherein each suspension beam (51, 52) is connected at an intermediate region to the lumbar support (4).

7. Child carrier (1) according to any of the preceding clauses, wherein the child carrier further comprises an abdominal pad (23) for bearing upon an abdominal region of the person, wherein the abdominal pad (23) is fixed to the seat bottom (22) of the child seat.

8. Child carrier (1) according to clause 7, wherein the lumbar support (4) and abdominal pad (23) are incorporated into a waist belt (6) for surrounding a waist of the person.

9. Child carrier (1) according to clause 7 or 8, wherein the abdominal pad (23) has at least one lateral end comprising the seat bottom connector (220) which is manually releasable from the lumbar support (4) or the suspension beam (51, 52).

10. Child carrier (1) according to any of the preceding clauses, wherein the child carrier further comprises at least one thigh support (9) arranged to be positioned against a person's thigh when wearing the child carrier.

11. Child carrier (1) according to clause 10, wherein the thigh support (9) comprises a thigh pad (90) mounted to a thigh pad arm (91) which is connected to a proximal beam end (501) for transferring a load from a suspension beam (51, 52) to the person's thigh.

12. Child carrier (1) according to clause 10 or 11, wherein the thigh support (9) is rotatably connected to the proximal beam end by a pivot housing (92) which connection is biased by a spring (93), wherein in particular the spring (93) is manually releasable by a user to reduce a pressure provided by the thigh support (9).

13. Child carrier (1) according to any of the preceding clauses, wherein the child carrier further comprises a chest belt (8) for surrounding a chest of the person, wherein the chest belt (8) is connectable to the child seat (2) or the pair of suspension beams (5).

14. Child carrier (1) according to any of the preceding clauses, wherein the child carrier further comprises a shoulder belt (7), wherein the shoulder belt (7) is connectable to at least one of the pair of suspension beams (5) and the child seat (2).

The above described embodiments and the dependent clauses and claims are applicable to all mentioned aspects.

BRIEF DESCRIPTION OF THE DRAWINGS

The invention will be explained in more detail with reference to the appended drawings. The drawings show a practical embodiment according to the invention, which may not be interpreted as limiting the scope of the invention. Specific features may also be considered apart from the shown embodiment and may be taken into account in a broader context as a delimiting feature, not only for the shown embodiment but as a common feature for all embodiments falling within the scope of the above clauses and appended claims, in which:

DETAILED DESCRIPTION OF THE INVENTION

Figures 1, 2, 3:
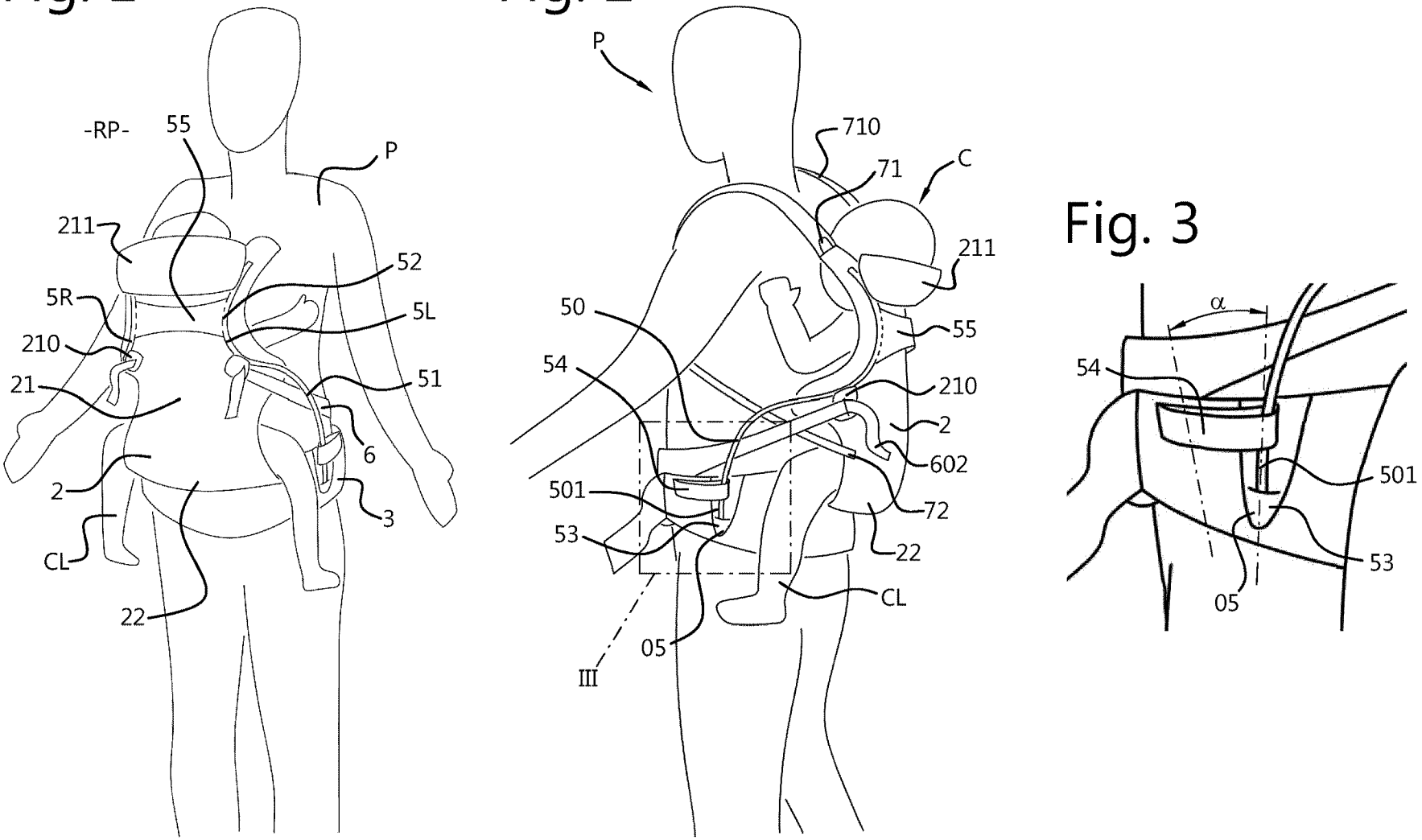
FIG. 1 shows in a perspective view a wearable child carrier according to the invention having a child seat supported from a hip belt by a pair of suspension beams.
FIG. 2 shows the child carrier being flipped around the person's body to carry a child on a person's back.
FIG. 3 shows an enlarged view of a pivotal connection of a lower beam portion by a beam connector including a beam stopper for limiting a beam pivot angle.

In FIGS. 1-15, the wearable child carrier is denoted overall by reference numeral 1. Identical reference signs are used in the drawings to indicate identical or functionally similar components. To facilitate comprehension of the description and of the claims the words vertical, horizontal, longitudinal, cross-sectional are to be interpreted with reference to gravity are used in a non-limiting way. Unless defined otherwise, all technical and scientific terms used herein have the same meaning as commonly understood by one of ordinary skill in the art to which this invention belongs.

FIG. 1 shows in a perspective view a wearable child carrier 1 according to the invention. The child carrier 1 is arranged to be worn by a person P for holding a child C close to his torso.

The child carrier 1 has a hip support 3. The hip support 3 includes a hip belt 30 for surrounding a pelvic region PR of the person. The hip belt 30 has extreme ends. The ends of the hip belt are provided with a hip belt closure 31. Each extreme end of the hip belt 30 is provided with a closure member of the hip belt closure 31. The hip belt closure has a first closure member and complementary second closure member which are positioned at the extreme ends of the hip belt.

Further, child carrier 1 is provided with a child seat to for holding the child C. The child seat has a seat bottom 22 and a backrest 21. The seat bottom 22 is connected to the hip support. The seat bottom 22 may be directly connected to the hip belt 30. Alternatively, the child carrier 1 may comprise an abdominal pad 23 for bearing upon an abdominal region of the person P. The abdominal pad 23 is fixed to the seat bottom 22. The abdominal pad 23 may be incorporated into the hip support 3, such that the hip belt 30 and the abdominal pad 23 form a one-piece item.

In an alternative embodiment of the child carrier 1, the abdominal pad 23 may be connected to the pair of suspension beams 5. The abdominal pad 23 may be permanently fixed to the pair of suspension beams 5. Alternatively, the abdominal pad may be releasably connected by a seat bottom connector 220.

The child seat 2 is positioned at a middle region of the head belt 30. Herewith, the child seat 2 is positioned opposite the hip belt closure 31 when wearing the child carrier. In use, the child seat is positioned at a torso side opposite the hip belt closure 31. As shown in FIG. 1, the child seat 2 can be held at a front of the torso, wherein the hip belt closure 31 is positioned at a back of the person. FIG. 2 shows an alternative positioning in which the child seat is positioned at a back of the person and in which the hip belt closure 31 is positioned at a front of the person.

Further, the child carrier 1 comprises a pair of suspension beams 5. The pair of suspension beams include a left and right suspension beam 5L, 5R. The suspension beams serve to transfer a load from the child seat 2 to the hip support 3. Each suspension beam has a beam body 50 being connected to the child seat 2. The beam body 50 is connected to a side region of the backrest 21. A proximal beam end 501 is connected to the hip support 3.

The child carrier 1 according to the invention is beneficial in that it provides an improved load transfer from the child seat 2 to the hip support 3. The connection of the suspension beams 5L, 5R to the child seat 2, preferably to the backrest 21, provides a direct transfer via a short path from the child seat 2 to the hip belt 30. The connection of the suspension beams to the backrest is located nearby a point of gravity of the child seat, such that an introduced momentum can be effectively compensated by the pair of suspension beams 5.

The positioning of the hip belt closure 31 opposite the child seat is beneficial in that it allows that each suspension beam 5 can be unreleasable fixed to the child seat 2. The positioning simplifies putting on steps to start wearing the child carrier. The child carrier can the put on the person's torso by placing the child carrier against the torso and then closing the hip belt closure 31. In comparison with a hip belt closure 31 positioned at a same side of the child seat, a step in motion or overhead pulling is avoided. The fixture of the beam body 50 to the child seat 2 is a permanent connection. The fixture contributes to a child carrier safety in that the child seat 2 cannot be undesirably released in an unexpected situation.

Each beam body 50 has a lower beam portion 51 which is provided with a curvature. The curvature of the beam body 50 extends away from the hip belt 30 in a substantial perpendicular direction. The curvature is directed towards the child seat 2. Here, the curvature deflects from a vertical to the child seat about a tangential curvature angle of at least 30°, in particular at least 45°.

The beam body 50 is laterally connected to the backrest 21 of the child seat 2. The left suspension beam 5L is connected to a left side of the child seat 2. The right suspension beam 5R is connected to a right side of the child seat. When a child is received in the child seat 2, the beam body 50 extends over a child leg CL. Together with an edge of the seat bottom 22, the curved beam body 50 delimits a child's leg opening. The child's leg CL is put through the child's leg opening. Herewith, the beam body 50 beneficially forms a lateral restraint to restrain the child in the child seat 2. Besides providing a support to the child seat, the curved suspension beam further contributes to a child carrier safety by forming a lateral restraint.

The beam body 50 has a S-shape. Each beam body 50 has an upper beam portion 52 which has a curvature in a direction opposite the direction of the curvature of the lower beam portion. Here, each upper beam portion 52 extends along an edge region of the backrest 21, in particular along a headrest 211 of the backrest. Here, the upper beam portion is curved along a smaller radius than a radius of the curvature of the lower beam portion. The upper beam portions provide a reinforcement to the child seat 2.

Here, the upper beam body portions of the left and right suspension beam are interconnected by a bridge member 55. The bridge member 55 is plate shaped. The bridge member 55 may be an additional item or may be formed by a thickening of the backrest 21. Here, the backrest 21 includes a headrest 211. The upper beam portions 52 and the bridge member 55 provide a reinforcement to the headrest 211.

Here, as further shown in the enlarged view of FIG. 3, the proximal beam end 501 is pivotally connected to the head belt 30 by a beam connector 53. Here, the proximal beam end 501 is received in a belt pocket which forms the beam connector 53. The proximal beam end is pivotally about a beam pivot point 05. The beam pivot point 05 is positioned at a side region of the hip belt 30. A left and right beam pivot point 05L, 05R together form a substantially horizontal axis. The pivotal connection 05 allows the pair of suspension beams 5 to rotate in a forward and backward direction, such that the child seat 2 may move away or towards the person's body.

Here, besides a flexibility of the suspension beams, the rotational movement of the pair of suspension beams 5 is limited by a beam stopper 54. The beam stopper 54 is provided to limit a pivotal movement about a predetermined beam pivot angle $\alpha$. The beam stopper 54 determines a maximum rotation of the pair of suspension beams 5, e.g. for at most 25°. Here, the beam stopper 54 is formed by a looped strap being positioned above the belt pocket.

Figure 4:
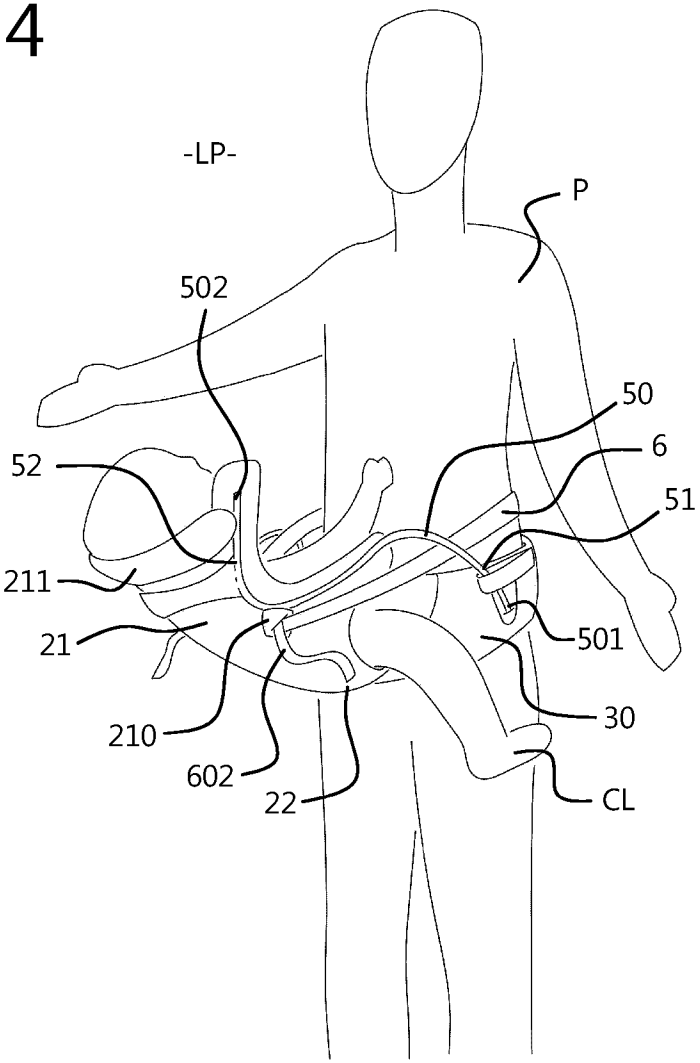
FIG. 4 shows the child carrier of FIG. 1 in a lowered position in which the child seat is pivoted away from a person's upper body.

FIG. 4 shows the child carrier in a lowered position LP. In the lowered position LP, the child seat 2 is rotated away from a raised position RP—as shown in FIG. 1—in which the child C is in a more upright position nearby the person's torso. In the lowered position LP, the child is positioned in a laid-back position.

The child carrier 1 further comprises a suspension support 6. Here, the suspension support 6 is formed by a waist belt 60. The suspension support 6 interconnects the child seat 2 and the hip support 3 and provides a support to the child seat 2 in the lowered position LP.

Figure 5:
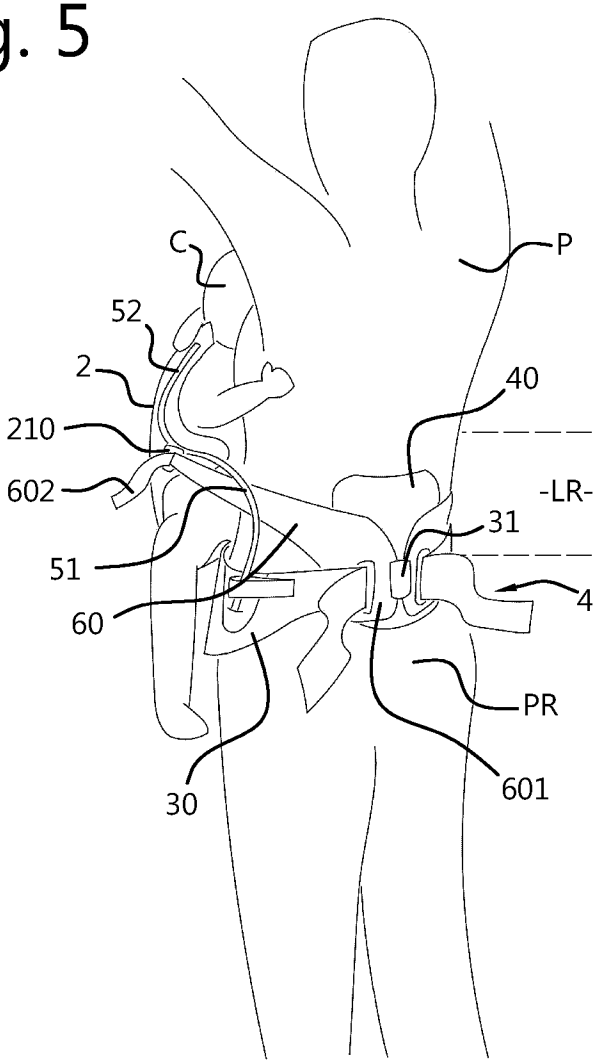
FIG. 5 shows a rear view of the person wearing the child carrier of FIG. 1 showing a hip belt closure positioned on his lower back.

As further shown in FIG. 5, the suspension support 6 has a proximal end 601 which is connected to the hip belt 30. Here, the proximal end 601 is connected to the hip belt 30 at a position of the hip belt closure 31. A distal end 602 of the suspension support 6 is connected to the child seat 2, in particular to the backrest 21. Both the proximal and distal end 601, 602 can be permanently fixed to respectively the hip support 3 and the child seat 2. To put the child carrier 1 onto the upper body, only the hip belt closure 31 needs to be closed.

In an alternative embodiment, the distal end 602 of the suspension support 6 may be connected to a suspension beam 5. The distal end 602 of the suspension support is connected to one of the child seat 2 and the beam body 50 by a suspension support connector, in particular a backrest connector 210. Preferably, the backrest connector 210 is configured to adjust a length of the suspension support 6 to adjust the lowered position LP of the child seat 2.

As shown in FIG. 5 at a back of the person P, the child carrier 1 further comprises a lumbar support 4. The lumbar support 4 is adapted to provide a bearing upon a lower back portion of the person P. Here, the lumbar support 4 comprises a lower back panel 40. The lower back panel 40 is connected to one of the hip belt ends. The lower back panel 40 is positioned at the hip belt closure 31. Here, the hip belt closure 31 is stacked on top of the lower back panel 40. The lower back panel 40 is shaped in correspondence with a human lower back. The lower back panel 40 is configured to transfer a load originating from the child seat 2 to the lower back of the person P. The lower back panel 40 forms an enlarged area of the hip support 3 to distribute the load. Herewith, the lumbar support contributes to a level of comfort of the child carrier.

Figure 7:
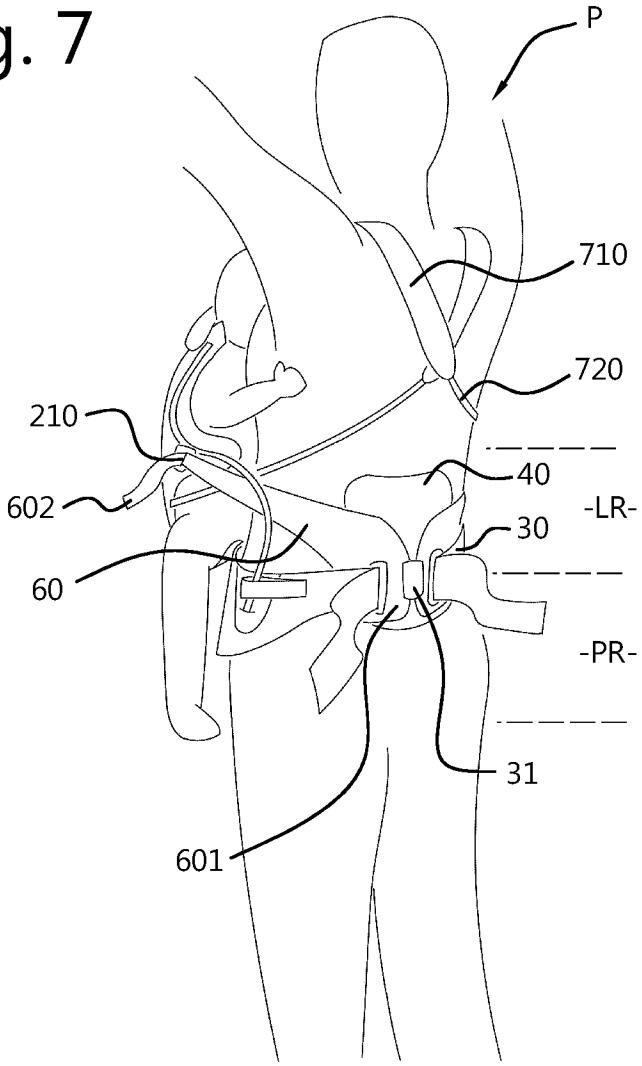
FIG. 7 shows the child carrier of FIG. 4 in a rear view in which the shoulder belts are crosswise connected.
Figure 6:
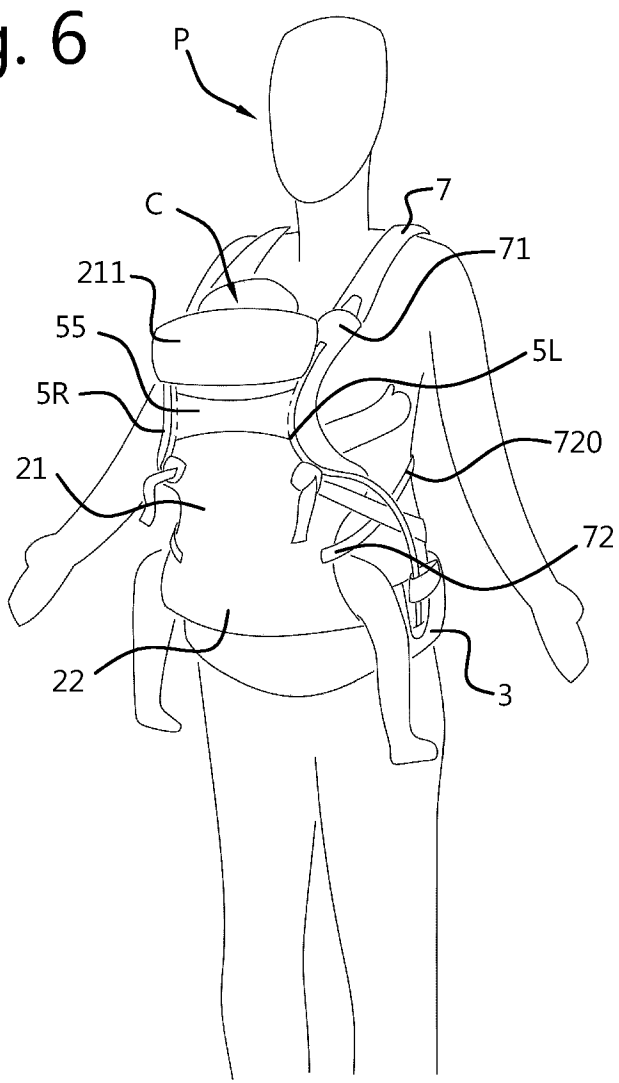
FIG. 6 shows the wearable child carrier of FIG. 1 provided with an additional pair of shoulder belts.

As shown in FIGS. 6 and 7 the child carrier 1 further comprises a shoulder belt 7. The shoulder belt 7 includes a shoulder band 710 which is configured to extend across a person's shoulder. The shoulder band 710 may be padded to provide some comfort. The shoulder belt 7 further comprises a shoulder strap 720. The shoulder belt 7 is connectable by an upper shoulder belt connector 71 to an upper region of the child seat 2. Here, the upper shoulder belt connector 71 is positioned at a headrest 211 of the child seat. The shoulder belt 7 is connectable by a lower shoulder belt connector 72 to a lower region of the backrest 21. The shoulder strap 720 is connected to the backrest 21. Alternatively, the shoulder strap 720 may be connected to the suspension beam 5.

Thus, the invention provides a wearable child carrier 1 to be worn by a person P to carry a child C close to his torso. The child carrier 1 comprises a hip belt 30, and a child seat 2 with a seat bottom 22 and a backrest 21. The child carrier 1 is provided with a pair of suspension beams 5 for transferring a load from the child seat 2 to the hip support 3. Each suspension beam 5L, 5R has a beam body 50 with a proximal beam end 501 being connected to the hip support 3. Each beam body 50 is connected to the backrest 21 of the child seat 2. The connection to the backrest is beneficial in that an improved load transfer from the child seat to the hips is obtained. In addition, the beam body 50 may form a leg restraint for the child to provide lateral stability.

Figure 8:
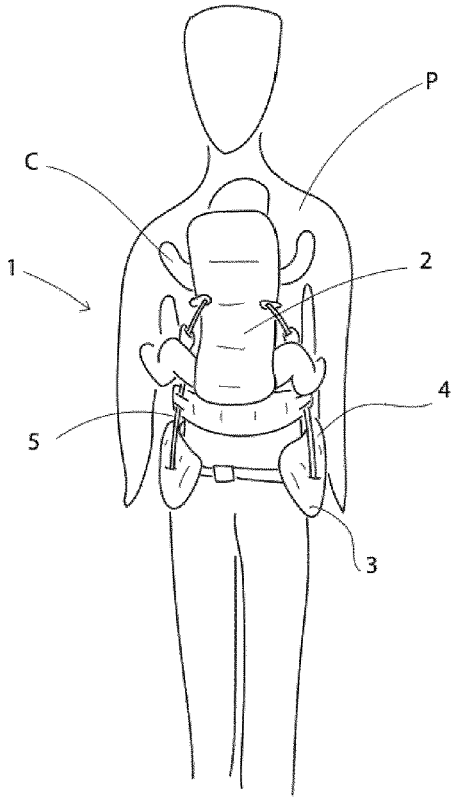
FIG. 8 shows a first embodiment of the child carrier according to the invention.

FIG. 8 shows in a frontal view a basic embodiment of a child carrier according to the invention. The child carrier 1 is arranged for carrying a child C. A person P is illustrated wearing the child carrier 1 for holding the child C against an upper body of the person P. Here, the child carrier is worn by the person at a front of the upper body. The child carrier is a child carrier of a type in which a child is carried at a front side of a person. This child carrier 1 is a so called front-carry child carrier.

A child is to be received in a child seat 2 of the child carrier. As further shown in FIG. 9, the child seat has a backrest 21 for supporting a child's back and a seat bottom 22 for supporting the child from below in between the child legs Cl. When a child is received in the child seat 2, the child legs extend downwardly from the seat bottom 22.

Figure 9:
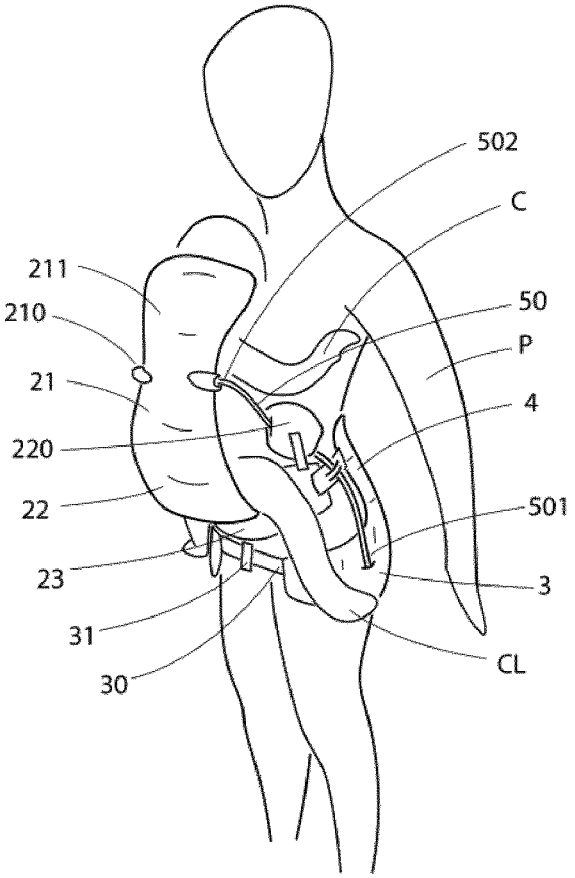
FIG. 9 shows an embodiment of the child carrier including a height adjustment of a child seat.

The child seat 2 may be formed a flexible pouch or by a rigid body. The child seat 2 may comprise a seat shell to provide rigidity to the seat. The child C in the child seat may face away from the person, but in a preferred use as shown, the child is facing to the carrying person and resting with its back to the backrest 21 of the child seat. As shown in FIG. 9, the backrest 21 may comprise a head rest 211 for supporting a head of a child. The head rest 211 may be a detachable item or integrally shaped with the backrest 21. The backrest may include a rigid structure at a central region to provide rigidity to the headrest.

Figure 15:
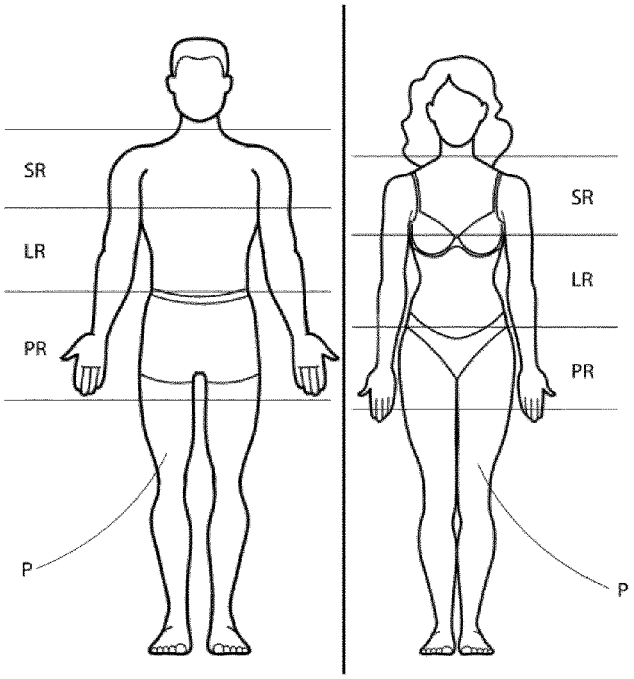
FIG. 15 schematically illustrates a pelvic region, lumbar region and shoulder region of a person.

The child carrier 1 comprises a hip support 3. The hip support 3 includes a hip belt 30 for encircling a pelvic region of the person. The pelvic region of a person is indicated in FIG. 15. When wearing the child carrier, the hip belt 30 extends around the hip bones and pelvic of the person. The hip belt 30 is configured to be fastened by the person around the hips. The hip belt has a hip belt closure 31 at a front side for manually locking the hip belt 30 when placed around the hips.

The hip support 3 further has a lower back portion which is resting onto the glutes of the person when wearing the hip support 3. The lower back portion is here integrally shaped with the hip support. The lower back portion forms a lumbar support 4 for bearing upon a lower back portion of the person. Herewith, the hip support is stably attachable to the person.

Further, the child carrier comprises a pair of suspension beams 5. The pair of suspension beams 5 comprises a left and right suspension beam 51,52. The backrest 21 of the child seat is connectable to the pair of suspension beams 5. The backrest is provided with a left and right backrest connector 210 for connecting the backrest to respectively the left and right distal beam end 502. The person P may release one of the backrest connectors 210 and the hip belt closure 31 for putting off the child carrier.

Each suspension beam 51,52 has an elongated beam body 50. A proximal end of the beam body 50 is connected to the hip support 3. The proximal beam end 501 is positioned at a lateral side of the hip support 3 substantially corresponding with a hip joint of the person. Each beam body 50 has a distal beam end 502 extending away from the hip support 3 in front of the person. The distal beam end 502 is spaced from the person's upper body.

Figure 10:
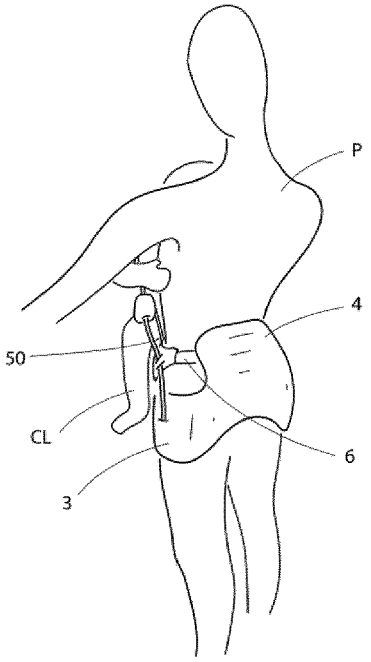
FIG. 10 shows a rear view of the child carrier of FIG. 9.

FIG. 9 and FIG. 10 respectively show in a perspective front and rear view a more advanced embodiment of the child carrier. With respect to the embodiment of FIG. 8, the hip support is provided with an enlarged lower back portion 40 to increase a size of the lumbar support 4. The lumbar support 4 is bearing on a larger area of the lower back of the person. Particularly, the lumbar support 4 has a height of at least 10 cm. Here, the lumbar support covers at least 80% of a lower half of a lower back cavity.

FIG. 9 illustrates a height adjustment of the child seat 2 with respect to the hip support 3. The child seat 2 has a seat bottom 22 which is provided with an abdominal pad 23, also called a belly pad. The belly pad 23 is configured to be worn against the belly of the person. The belly pad 4 is connectable to the lumbar support 4. The belly pad 23 and the lumbar support 4 together form a waist belt 6 adapted to encircle a waist of the person. Here, the waist belt is connected to the left and right suspension beam 51,52 which provides further stability to the pair of suspension beams 5.

The seat bottom 22 is adjustable in height with respect to the suspension beams 5. At each side, the belly pad 23 is connected to the suspension beam by a seat bottom adjuster 29. Here, the seat bottom adjuster 29 comprises an adjuster housing 291 including a strap 292 to adjust a relative height of the seat bottom 22. The adjuster housing 291 is mounted to the suspension beam at a fixed position. Here, the adjuster housing 291 is mounted in an upper half portion of the suspension beam 51. The strap 292 is extending in between the adjuster housing 291 and the belly pad 23. The strap can be lengthened or shortened to adjust a height of the seat bottom 22. Here, the waist belt 6 is slidably connected to the suspension beam 51. Advantageously, herewith the seat bottom 22 is adjustable in height with respect to the hip support, such that the child carrier can be worn by a person in which the hip support firmly rests onto the glutes, while at the same time, a child is optimally positioned in height with respect to a torso of the person. The child seat 2 is easy adaptable by adjusting the seat bottom to optimally carry either a newborn baby or a one year old toddler while maintaining the stable positioning of the hip support onto the glutes and a desired height of the child relative to the upper body keeping a child head at a shoulder region of the person.

Figure 11:
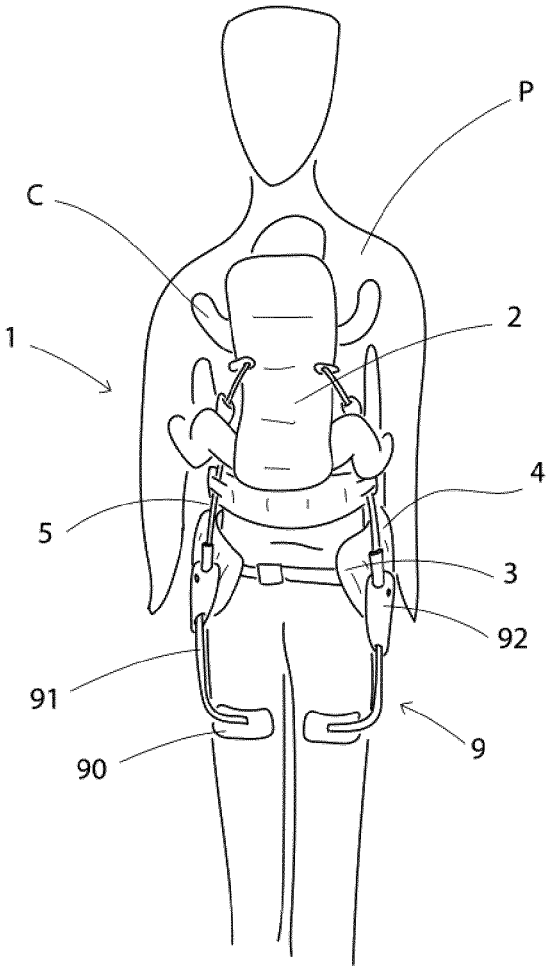
FIG. 11 shows an embodiment of the child carrier including a left and right thigh support.

FIG. 11 shows a frontal view of an embodiment of the child carrier 1 as illustrated in FIG. 1 in which the child carrier 1 further comprises at least one thigh support 9. Here, the child carrier is provided with a left and right thigh support. The thigh support has a thigh pad 90 arranged to bear upon a person's thigh. The thigh pad 90 is connected to a thigh pad arm 91. Here, the thigh pad arm 91 is shaped to extend along a lateral side of the person's leg. A proximal end of the thigh pad arm 91 is connected to the hip support 3.

Here, the thigh pad arm 91 is pivotally connected to the hip support 3. Preferably, a pivot axis of the pivot connection is positioned at the hip support to align with a hip-leg joint of the person. In particular, the thigh pad arm 91 is mounted by a thigh support pivot housing 92 to a proximal beam end 501 of a suspension beam. Both the suspension beam 51 and the thigh pad arm 91 are connected to the same housing 92. Herewith, a load from a suspension beam is directly transferred via the pivot housing 92 and the thigh pad arm 91 to the thigh pad 90 to a person's leg.

The thigh pad arm 91 may be adapted in flexibility to provide a predetermined pressure on to a leg. In particular, the thigh support 9 is biased by a spring 93. The spring 93 may be a torsional spring or a gas spring inside the pivot housing 92. The spring 93 may be a releasable spring 93 to allow a user to adapt a spring tension. The releasable spring tension is beneficial to allow a user to release the spring tension when using the child carrier during a walk. In that case, the spring tension may be strongly reduced or eliminated to allow a free movement of a person's leg.

Figure 12:
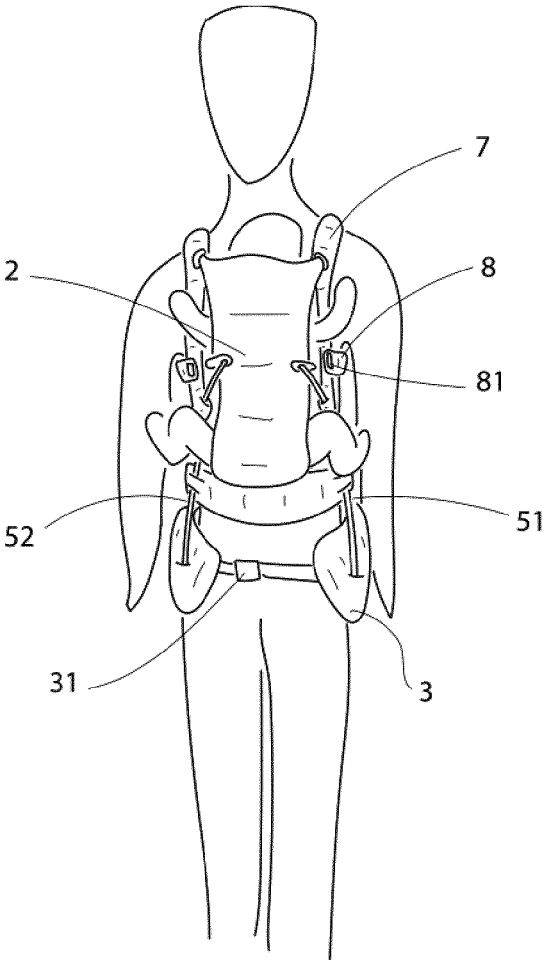
FIG. 12 shows an embodiment of the child carrier including a chest belt.
Figure 13:
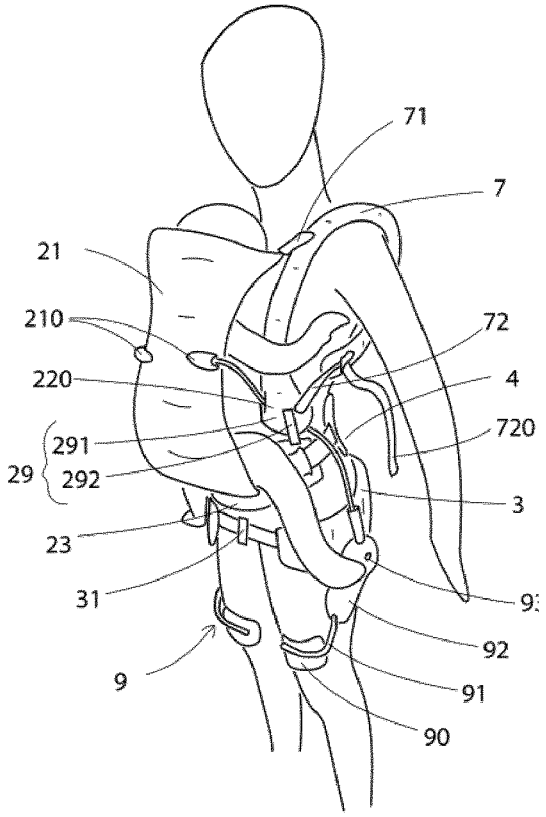
FIG. 13 shows an embodiment of the child carrier including a shoulder belt.

FIG. 12 shows an embodiment of the child carrier as illustrated in FIG. 8 in which the child carrier further comprises at least one shoulder belt 7 and/or a chest belt 8 in addition. The shoulder belt and/or the chest belt 8 are connected to the pair of suspension beams 5 to keep the child seat close to the upper body, in particular the shoulder region SR of the person.

The chest belt 8 is connected to the child seat 2 to prevent a movement of the child seat 2 away from the upper body. The chest belt 8 may be directly connected to the child seat 2. Preferably, as shown, the chest belt 8 is connected to the pair of suspension beams 5 to prevent the suspension beams bending away from the upper body. Herewith, the suspension beams function to transfer a weight of the child to the hip support, while the chest belt 8 contributes in compensating an introduced momentum. The chest belt 8 has a chest belt closure 81. The chest belt closure 81 is preferably positioned to be situated at a lateral side of a person's upper body.

The at least one shoulder belt 7 may also function to reduce an introduced momentum. Here, a pair of shoulder belts is provided which is shown in further detail in FIGS. 13 and 14.

The shoulder belt 7 comprises an upper shoulder belt connector 71 for connecting the shoulder belt 7 to the backrest 21 of the child seat 2. Here, the upper shoulder belt connector 71 connects the headrest 211 to the shoulder belt 7.

The shoulder belt 7 is adjustable in length to adapt to a person's body. The shoulder belt 7 has a lower shoulder belt connector 72 in which the shoulder belt 7 is connected to the left or right suspension beam 51, 52. Here, the shoulder belt 7 is connected by a shoulder strap 720 forming the lower shoulder belt connector 72 to the seat bottom connector 220 formed by the adjuster housing 291 which is mounted to the suspension beam 51.

Figure 14:
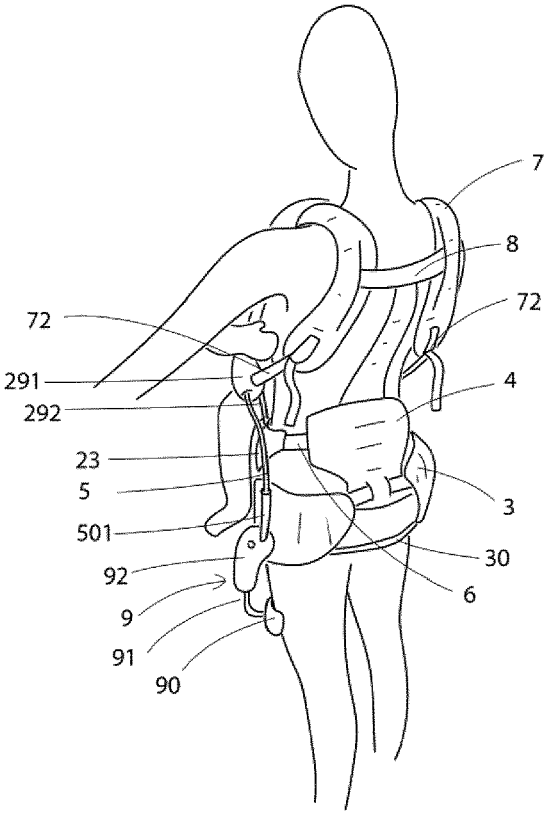
FIG. 14 shows a rear view of the child carrier of FIG. 13.

As shown in FIG. 14, the chest belt 8 may be incorporated in the pair of shoulder belts 7. The chest belt 8 interconnects the left and right shoulder belt. Functionally seen, the chest belt 8 which is partly formed by the lower portions of the shoulder belt 7 extends in between the left and right suspension beam 51, 52. Herewith, the chest belt 8 contributes in stabilising the suspension beams.

FIG. 15 schematically shows several upper body regions to be distinguished regarding the components of child carrier 1. At the lower part of the trunk between the abdomen and the thighs, a pelvic region PR is defined. The pelvic region PR is located at the hip bones and bony pelvis. A lumbar region LR is defined above the pelvic region PR below a shoulder region SR. The lumbar region LR constituting the loins between the thoracic vertebrae and sacrum. The lumbar region LR includes a back side region, and a left and right lumbar region lateral of an abdominal region at a front. A waist region of the upper body is defined by the abdominal region together with the lumbar region. The shoulder region SR is defined by the thoracic vertebrae. Generally appointed as forming a person's chest, meaning a person's shoulders and rib cage.

Thus, in the second aspect, the invention provides a wearable child carrier comprising a hip support with a hip belt, a lumbar support and a pair of suspension beams. The child carrier includes a child seat with a backrest which is connectable by at least one manually releasable backrest connector to a distal beam end of one of the suspension beams. A weight of a child sitting in the child seat is transferred via the pair of suspension beams to the hip support positioned at the pelvic region. Due to the effective transfer of the load, the child carrier can advantageously be embodied without any additional cumbersome belts surrounding the upper body.

Although the present invention has been described in detail, it will be apparent to those skilled in the art that various changes and modifications can be made without departing from the scope of the invention as hereinafter claimed. It is intended that all such changes and modifications be encompassed within the scope of the present disclosure and claims.

Reference signs list:

| | |
|---|---|
| P person | 05 beam pivot point$\alpha$ beam pivot angle |
| PR pelvic region | 50 beam body |
| LR lumbar region | 51 lower beam portion |
| SR shoulder region | 52 upper beam portion |
| LP lowered position | 501 proximal beam end |
| RP raised position | 502 distal beam end |
| C child | 5L left suspension beam |
| CL child leg | 5L left suspension beam |
| 1 child carrier | 53 beam connector; belt pocket |
| | 54 beam stopper |
| 2 child seat | 55 bridge member |
| 21 backrest | |

-continued

| Reference signs list: | |
|---|---|
| 210 backrest connector; suspension support connector | 6 suspension support |
| 211 head rest | 601 waist belt proximal end |
| 22 seat bottom | 602 waist belt distal end |
| 23 abdominal pad | |
| 220 seat bottom connector | 7 Shoulder belt |
| 29 seat bottom adjuster | 71 upper shoulder belt connector |
| 291 adjuster housing | 710 shoulder band |
| 292 adjuster strap | 72 lower shoulder belt connector |
| | 720 shoulder strap |
| 3 Hip support | |
| 30 Hip belt | 8 chest belt |
| 31 hip belt closure | 81 chest belt closure |
| 4 lumbar support | 9 thigh support |
| 40 lower back panel | 90 thigh pad |
| | 91 thigh pad arm |
| 5 Pair of suspension beams | 92 pivot housing |
| 5L left suspension beam | 93 spring |
| 5R right suspension beam | |

The invention claimed is:

1. A wearable child carrier to be worn by a person to carry a child against a torso of the person, which child carrier comprises:

a hip support including a hip belt for surrounding a pelvic region of the person, in which ends of the hip belt are provided with a hip belt closure;

a shoulder belt;

a child seat for holding a child which child seat has a seat bottom and a backrest;

a pair of suspension beams for transferring a load from the child seat to the hip support in which each suspension beam has a beam body with a proximal beam end being connected to the hip support, wherein each beam body is connected to the backrest of the child seat; and a suspension support for interconnecting the child seat and the hip support for supporting the child seat in a lowered position which lowered position is relative to a raised position situated in a direction away from the person;

wherein a proximal end of the suspension support is connected to the hip belt at a position of the hip belt closure.

2. The wearable child carrier according to claim 1, wherein each beam body has a lower beam portion having a curvature directed towards the child seat.

3. The wearable child carrier according to claim 2, wherein the curvature of the lower beam portion extends away from the hip belt in a substantial perpendicular direction and deflects from a vertical to a tangential curvature angle of at least 30°.

4. The wearable child carrier according to claim 1, wherein the proximal beam end is pivotable about a beam pivot point connected to the hip belt and provided with a beam stopper to limit a pivotal movement about a predetermined beam pivot angle.

5. The wearable child carrier according to claim 1, wherein the child seat is positioned at a middle region of the hip belt to allow that in use the child seat is positioned at a torso side opposite the hip belt closure.

6. The wearable child carrier according to claim 5, wherein each suspension beam is secured to the child seat.

7. The wearable child carrier according to claim 1, wherein a distal end of the suspension support is connected with one of the child seat and the beam body by a suspension support connector.

8. The wearable child carrier according to claim 7, wherein the suspension support connector is configured to adjust a length of the suspension support to adjust the lowered position of the child seat.

9. The wearable child carrier according to claim 7, wherein the suspension support connector is a backrest connector.

10. The wearable child carrier according to claim 1, wherein the child carrier further comprises a lumbar support for bearing upon a lower back portion of the person.

11. The wearable child carrier according to claim 10, wherein the lumbar support is incorporated in the hip support.

12. The wearable child carrier according to claim 1, wherein the shoulder belt is connectable by an upper shoulder belt connector to an upper region of the child seat and by a lower shoulder belt connector to at least one of the pair of suspension beams and the child seat.

13. The wearable child carrier according to claim 1, wherein the suspension support is a waist belt.

* * * * *